US008360943B2

(12) United States Patent
Smith

(10) Patent No.: US 8,360,943 B2
(45) Date of Patent: Jan. 29, 2013

(54) BALANCE BOARD

(76) Inventor: Nicholas David Smith, Montpelier (GB)

( * ) Notice: Subject to any disclaimer, the term of this patent is extended or adjusted under 35 U.S.C. 154(b) by 0 days.

(21) Appl. No.: 13/301,050

(22) Filed: Nov. 21, 2011

(65) Prior Publication Data

US 2012/0065040 A1 Mar. 15, 2012

Related U.S. Application Data

(63) Continuation of application No. 12/304,713, filed as application No. PCT/GB2007/002245 on Jun. 15, 2007, now Pat. No. 8,062,199.

(30) Foreign Application Priority Data

Jun. 16, 2006 (GB) ..... 0612018.2
Mar. 2, 2007 (GB) ..... 0704032.2

(51) Int. Cl.
*A63B 21/00* (2006.01)

(52) U.S. Cl. ..... 482/146; 482/147; 482/79; 482/80

(58) Field of Classification Search ..... 482/146, 482/147, 79, 80, 34
See application file for complete search history.

(56) References Cited

U.S. PATENT DOCUMENTS

| | | | | |
|---|---|---|---|---|
| 3,488,049 | A | 1/1970 | Sasser | |
| 3,604,726 | A | 9/1971 | Tracy | |
| 3,895,794 | A | 7/1975 | England | |
| 4,191,371 | A | 3/1980 | Armer | |
| 5,795,277 | A * | 8/1998 | Bruntmyer | 482/146 |
| 6,916,276 | B1 | 7/2005 | Robinson | |
| 7,357,767 | B2 * | 4/2008 | Tsai | 482/146 |
| 7,566,291 | B2 | 7/2009 | Lickle | |
| 2004/0018924 | A1 * | 1/2004 | Szydlowski et al. | 482/146 |

FOREIGN PATENT DOCUMENTS

| | | |
|---|---|---|
| DE | 9314435 | 12/1993 |
| DE | 4411736 | 4/1995 |
| DE | 19933065 | 2/2000 |
| GB | 2139102 | 11/1984 |
| GB | 2407780 | 5/2005 |
| WO | 86/04250 | 7/1986 |
| WO | 2006/020524 | 2/2006 |
| WO | 2007/038881 | 4/2007 |

* cited by examiner

*Primary Examiner* — Jerome W Donnelly
(74) *Attorney, Agent, or Firm* — Fulwider Patton LLP

(57) ABSTRACT

A balance board has a top side and an under side. The under side is arranged to be mounted on top of a ball with a user balancing on the top side. The board is shaped to define a generally longitudinal direction and a direction generally transverse to the longitudinal direction. The board is formed from a first top portion defining the topside and having a substantially flat region on its under side and a second lower portion joined to the first top portion and defining a wall at least substantially bounding a portion of the flat region. The distance across the bounded portion in the longitudinal direction of the board is greater than in the transverse direction. With the bounded portion balanced on a ball with a diameter less than the distance across the bounded portion in the transverse direction, the board is enabled to move relative to the ball with at least a degree of spherical rotational freedom and also a degree of translational freedom in directions other than the vertical.

17 Claims, 6 Drawing Sheets

9
10
13
14
15
12
11
5
16
17

101
102
103
106
107

104
105
106
107
108

102

104
105
108
XVII
XVII 104
105

BALANCE BOARD

CROSS-REFERENCE TO RELATED APPLICATION

This application is a Continuation application that claims the benefit of U.S. patent application Ser. No. 12/304,713, filed Dec. 12, 2008, which in turn claims the benefit of PCT/GB2007/002245 filed Jun. 15, 2007, which claims the benefit of GB Application 0704032.2 Filed Mar. 2, 2007 which claims the benefit of GB Application 0612018.2 filed Jun. 16, 2006 the contents of which are hereby incorporated herein by reference.

BACKGROUND

This disclosure relates to balance boards.

Surfers, snowboarders and skateboarders want to be able to practice skills, notably balance, relevant to their particular sports at times when, for one reason or another (such as lack of snow or of surfable waves), it is not possible to practice the sport concerned. In an effort to meet this demand a number of devices, known generally as balance boards, have been suggested in the literature, and some of these are also commercially available. Such boards also have a use in Physiotherapy and in rehabilitation of accident victims. Balance boards also have value as sports and exercise items in their own right.

In general such devices comprise a board on which a user may stand, the board being supported by a rolling element of some form. Some such devices employ cylindrical rollers. Others employ a sphere mounted essentially in a fixed position beneath the board but free to roll in any direction carrying the board with it. The mounting of such spheres or rollers beneath a board presents significant manufacturing problems. Moreover, all these arrangements suffer from limitations in the exercises which the user can perform. In general they fall far short of the range of movements experienced in practice, for example when surfing. Balance boards have also been proposed in which the board is simply balanced on a ball. The user may frequently fall, for example by the ball rolling away from under the board. Boards have been provided with a substantial concave surface beneath the board. However, this results in a board with a complex construction, that is too expensive to sell on a commercial scale at a price which ordinary surfers, snowboarders and skateboarders can afford. These arrangements also failed satisfactorily to restrain movement of the ball beyond the cavity, as a smoothly concave shape right up to the lip simply guided the ball towards the lip, and a simple excess movement tended to carry the ball over the lip, causing the user to fall. Other attempts to restrict movement of the ball either restrict the range of different movements possible or still result in a board from which a user can easily fall in use. To the best of Applicant's knowledge no previous proposal has satisfactorily overcome this problem.

SUMMARY OF THE INVENTION

The present disclosure seeks to overcome these drawbacks in prior arrangements and, in particular, to do so by providing constructions that are relatively straightforward, and therefore relatively inexpensive, to manufacture.

Accordingly, in one aspect of this disclosure, there is provided a balance board having a top side and an under side, the under side being arranged to be mounted on top of a ball with a user balancing on the top side, the board being shaped to define a generally longitudinal direction and a direction generally transverse to the longitudinal direction, the board being formed from a first top portion defining said topside and having a substantially flat region on its under side and a second lower portion joined to the first top portion and defining a wall at least substantially bounding a portion of said flat region, the distance across said portion in the longitudinal direction of the board being greater than in the transverse direction, so that, with the said portion balanced on a ball with a diameter less than the distance across the said portion in the transverse direction, the board is enabled to move relative to the ball with at least a degree of spherical rotational freedom and also a degree of translational freedom in directions other than the vertical.

According to a second and alternative aspect of the present disclosure, there is provided a balance board having a top side and an under side, the under side being arranged to be mounted on top of a ball with a user balancing on the top side, the board being shaped to define a generally longitudinal direction and a direction generally transverse to the longitudinal direction, the board being formed from a first top portion defining said topside and a second lower portion substantially co-extensive with the top portion in the longitudinal and transverse directions and being joined to the first top portion, the second portion having a through opening therein, whereby a substantially flat portion of the underside of the first portion is exposed, said portion being bounded by a wall defined by said through opening, the distance across said portion in the longitudinal direction of the board being greater than in the transverse direction, so that, with the said portion balanced on a ball with a diameter less than the distance across the said portion in the transverse direction, the board is enabled to move relative to the ball with at least a degree of spherical rotational freedom and also a degree of translational freedom in directions other than the vertical.

In accordance with a third alternative aspect of the present disclosure, there is provided a balance board having a top side and an under side, the under side being arranged to be mounted on top of a ball with a user balancing on the top side, the board being shaped to define a generally longitudinal direction and a direction generally transverse to the longitudinal direction and having a substantially flat region on its under side to which is mounted a wall member that depends from said under side and defines a portion of said flat region within and bounded by said wall, the distance across said portion in the longitudinal direction of the board being greater than in the transverse direction, so that, with the said portion balanced on a ball with a diameter less than the distance across the said portion in the transverse direction, the board is enabled to move relative to the ball with at least a degree of spherical rotational freedom and also a degree of translational freedom in directions other than the vertical.

The boards work best with a ball whose diameter is less than the distance across the said portion in the transverse direction since translational movement in the transverse direction is then readily possible. A less satisfactory experience is achieved when the ball has a greater diameter, but the board may still be used with such over-size balls.

So far as the vertical direction is concerned, restraint in freedom of movement is not complete, as the ball may compress. A skilled user may also be able to perform tricks in which board and/or ball may be bounced.

The substantially flat region on the underside need not be entirely flat. It could be slightly dished at its centre, and the term "substantially flat" is to be understood to encompass such variations. However, the substantially flat region with a wall surrounding it is to be contrasted with the substantial concave region in some prior boards which may terminate in a lip. Apart from their expense, which is a major drawback, such prior arrangements fail satisfactorily to restrain movement of the ball beyond the cavity, as the smoothly concave shape right up to the lip simply guides the ball towards the lip, and a simple excess movement will carry the ball over the lip, causing the user to fall.

Preferably the board is symmetrical about the longitudinal direction and also symmetrical about the transverse direction.

The wall serves to restrain movement of ball and board relative to each other beyond a maximum extent so that the ball is restrained from simply rolling out from under the board, causing a user balancing on the board to fall. The wall cannot entirely prevent this happening; a determined or very inexperienced user may still be able to force the ball past the wall, with greater or lesser difficulty depending upon the height of the wall in relation to the diameter of the ball. The wall is preferably an endless wall, but may have discontinuities provided that the resultant gaps in what would otherwise be an endless wall are sufficiently small not to affect the ability of the wall to restrain the ball within it.

The board may be manufactured in two or more separate portions that are joined by adhesive or fasteners. If formed of plastics, it may be moulded as an integral structure.

Preferably the board and ball may be supplied together as a balance board set. Preferably the boundary defined by the wall has the shape of a flattened oval in under plan view to allow transverse motion with the ball located at its extreme in the longitudinal direction of the board so that a user may practice balance with the weight substantially taken by only one foot.

In the preferred arrangement, the distances across the said portion in the longitudinal and transverse directions are chosen to reduce the likelihood that the user will fall from the board by over-balancing. Thus, with the ball in each of its extreme positions in the longitudinal direction, the user's foot should be above or out-board of the centre of the ball, so that the user does not overbalance, and so fall off the board, when the board is horizontal and substantially all the user's weight is on that one foot. Similarly, with the ball in either of its extreme positions in the transverse direction, and the user is balancing either on their heels or on their toes, the positions of the heels or toes respectively should be over the centre of the ball. To allow for differences between individual users and the fact that they may practice with balls of different diameter, in preferred boards, the longitudinal distance across the bounded portion is preferably slightly less than the average stance (distance between a user's feet on the board), while the transverse distance across the bounded portion is slightly less than the average distance from heel to toes.

BRIEF DESCRIPTION OF THE DRAWINGS

Embodiments of balance board are hereinafter more particularly described by way of example only with reference to the accompanying drawings, in which:—

DETAILED DESCRIPTION OF THE PREFERRED EMBODIMENTS

Figure 1:
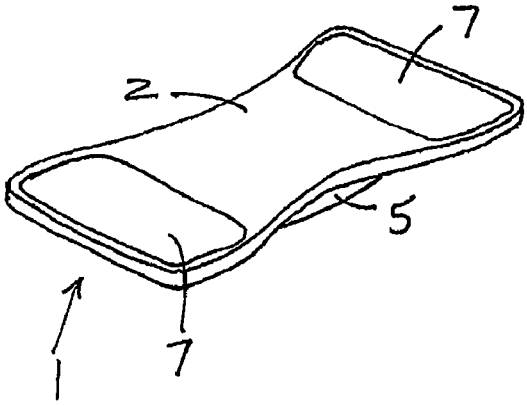
FIG. 1 shows an overall perspective view of an embodiment of balance board, as seen from above.
Figure 2:
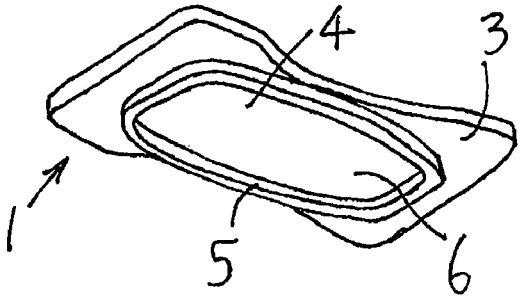
FIG. 2 shows an overall perspective view, seen from below, of the balance board of FIG. 1.
Figure 3:
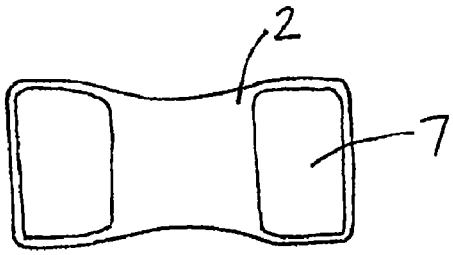
FIG. 3 is a top plan view of the balance board of FIGS. 1 and 2.
Figure 4:
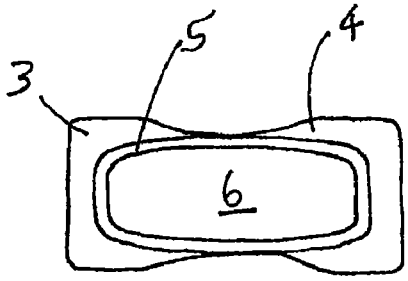
FIG. 4 is an under side plan view of the balance board of FIGS. 1 to 3.
Figure 5:
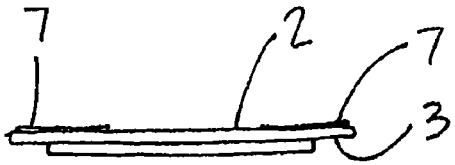
FIG. 5 is a side elevational view of the balance board of FIGS. 1 to 4.
Figure 6:
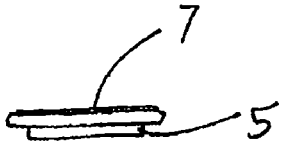
FIG. 6 is an end elevational view of the balance board of FIGS. 1 to 5.

Referring first to FIGS. 1 to 7, a balance board 1 has a top side 2 and an under side 3. The under side 3 includes a substantially flat region 4 to which is mounted an endless wall member 5 which, as explained in more detail below, is preferably made in several sections which are joined or abutted.

The endless wall 5 depends from the under side 3 and defines a portion 6 of the flat region 4 within and bounded by the wall 5. As can be seen, in particular from FIGS. 2, 4 and 5, the bounded portion 6 makes up the greater part of the under side of the board.

Top side 2 of the board is provided with spaced contact surfaces 7 at opposite longitudinal ends of the top side 2. Contact surface portions 7 are adapted to prevent a user's feet from slipping when using the board. In a preferred arrangement, a grip tape, for example the tape available from Heskins Ltd of Chorley, Lancashire, PR6 8RQ under the Trademark Safety-Grip™ or the tape available from TBS Eram-Industrie of Chalonnes-sur-Loire, France under the Trademark TBS Non-Slip™ is stuck to the top of the board to provide contact surface portions 7. In an alternative arrangement, a thin rubber or elastomeric plastics sheet provided with a textured and/or contoured upper surface may be adhered to the board. In a further alternative, wax of the kind employed by surfers in preparing surfboards for use may simply be applied to end regions 7 of the top surface 2 of the board.

Figure 7:
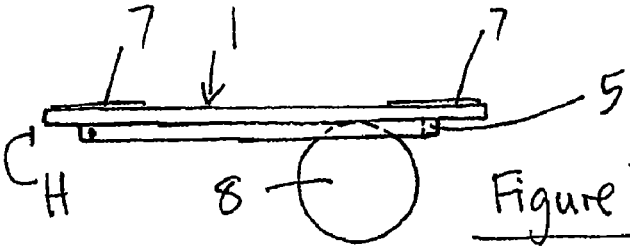
FIG. 7 is a view generally similar to FIG. 4 showing how the balance board co-operates with a ball.
Figure 8:
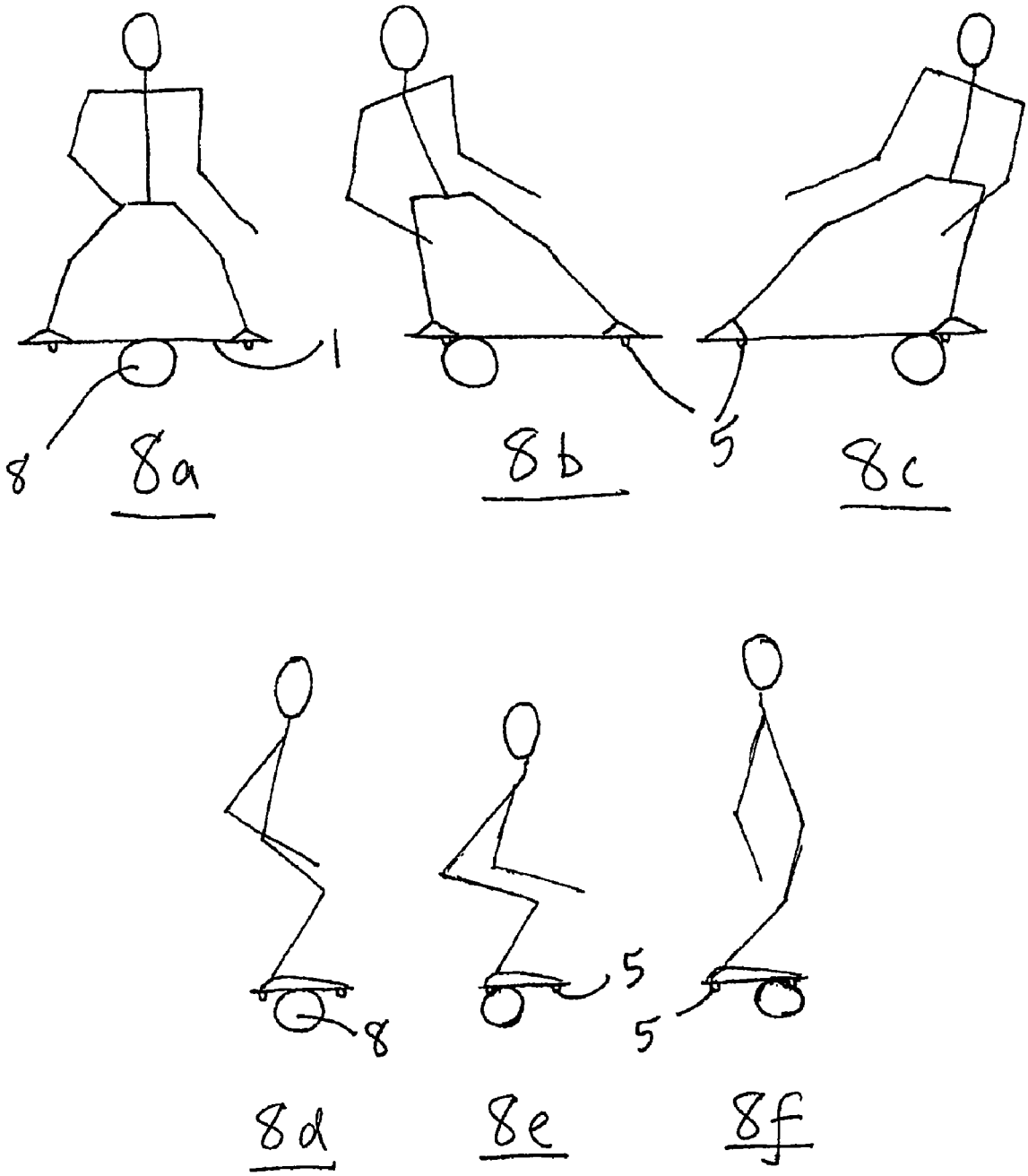
FIGS. 8*a* to 8*f* are schematic views illustrating how a user may adopt different positions balancing on the board.
Figures 10, 11:
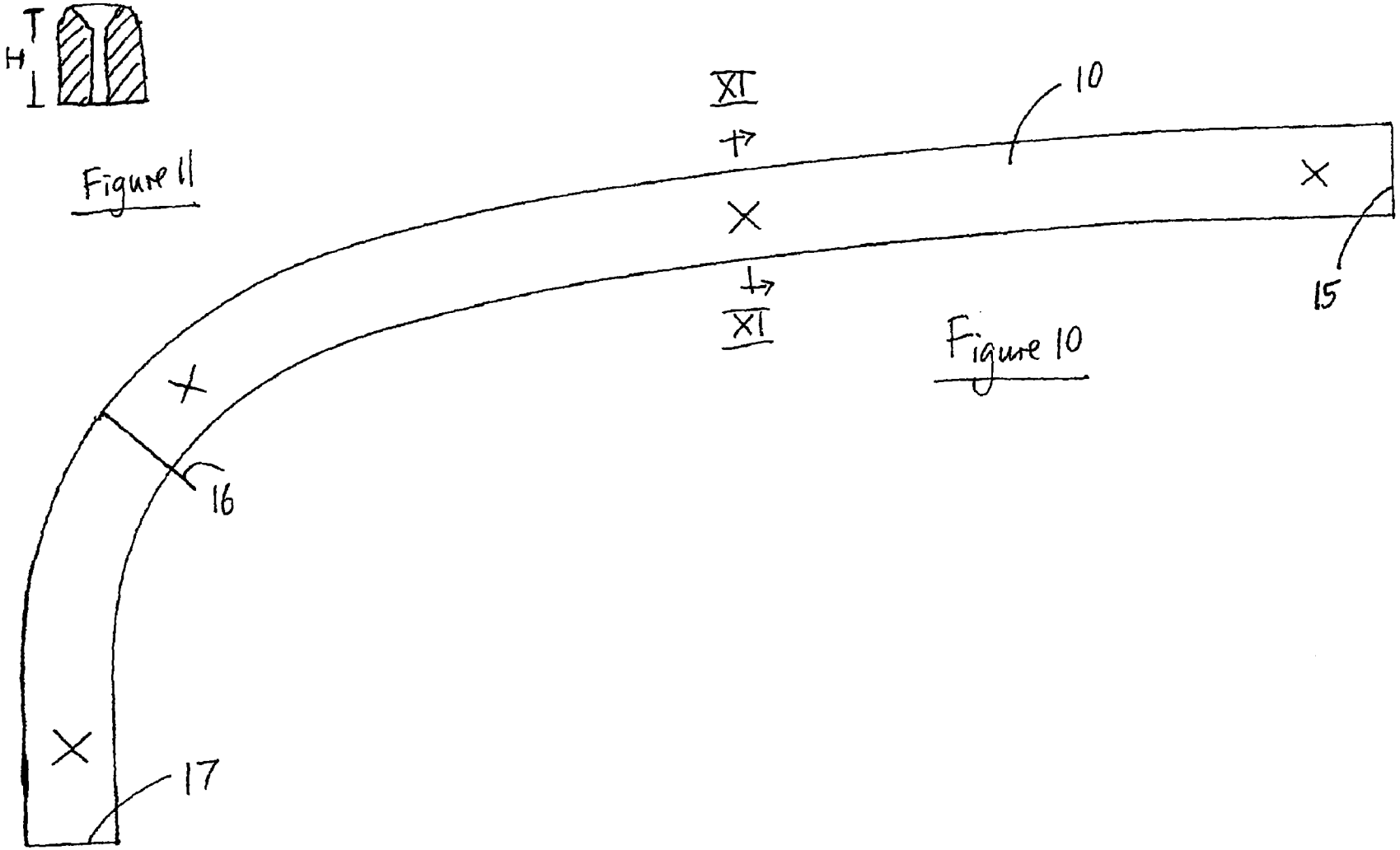
FIG. 10 is an enlarged view of a one-quarter segment of the wall of FIG. 9 illustrating positions for counter-sunk holes for coupling the wall to the under side of the board proper.
FIG. 11 shows a sectional view taken along the line XI-XI in FIG. 10.
Figures 12, 13, 14, 15, 16:
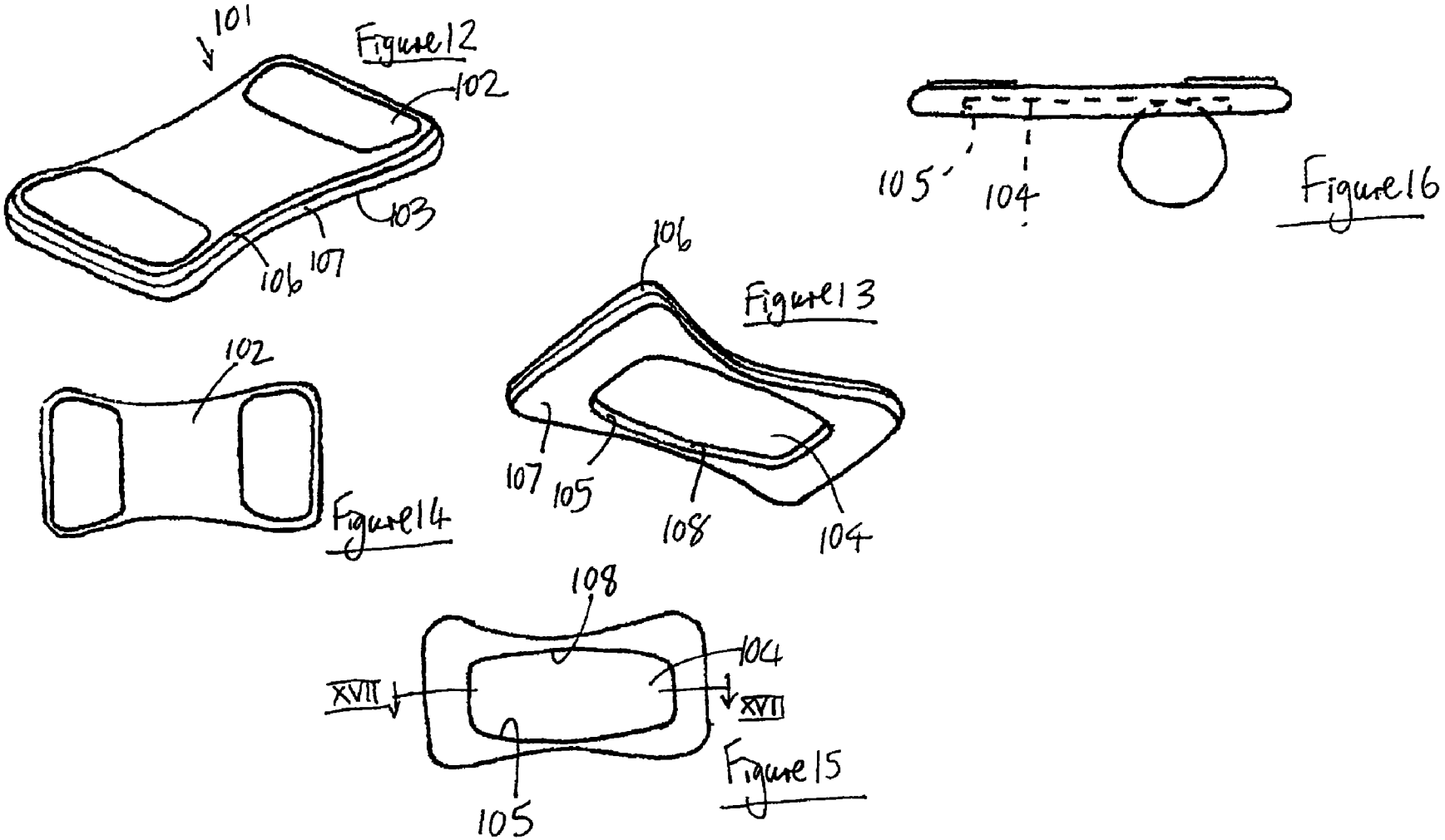
FIG. 12 shows an overall perspective view of a second embodiment of balance board, as seen from above.
FIG. 13 shows an overall perspective view, seen from below, of the balance board of FIG. 12.
FIG. 14 is a top plan view of the balance board of FIGS. 12 and 13.
FIG. 15 is an under side plan view of the balance board of FIGS. 12 to 14.
FIG. 16 is a side elevational view of the balance board of FIGS. 12 to 15, showing how the balance board co-operates with a ball.
Figure 17:
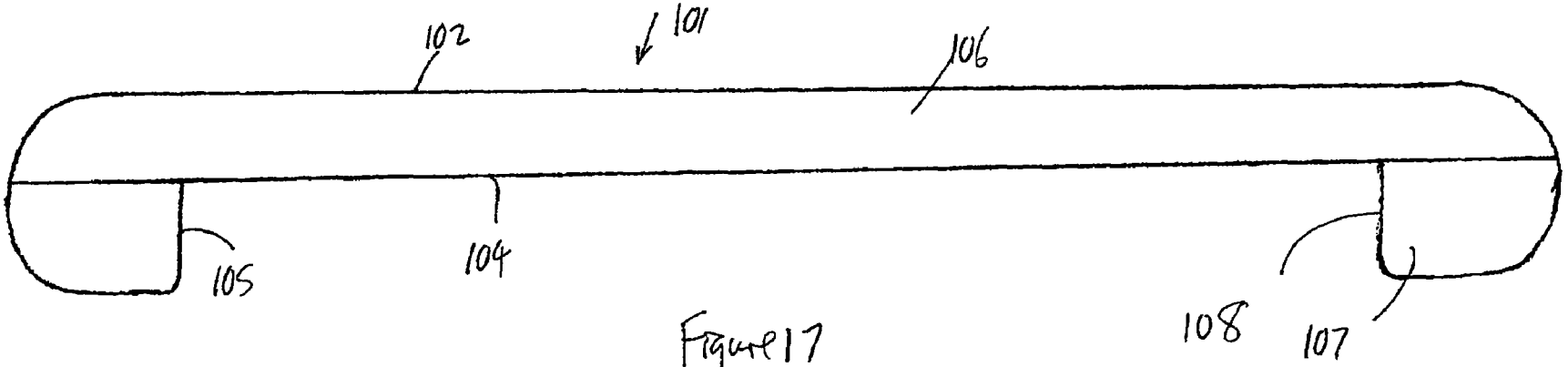
FIG. 17 shows an enlarged sectional view taken along the line XVII-XVII in FIG. 15.

Wall 5 depends from the under side 3 of the board by a height H (see FIGS. 7 and 10). While H could be less than the cross-section of wall 5, it is suitably no less than this cross-section, and preferably slightly greater (as in FIGS. 10 and 11). When the board 1 is placed on top of a suitable ball 8, which may simply be placed upon the ground or other surface, a user may balance on the board (see FIGS. 8*a* to 8*f*) with the ball largely constrained within a cavity effectively defined by bounded portion 6 and wall 5. As will be evident, the extent by which the ball is restrained by the wall 5 will depend upon the diameter of the ball and the height H of the wall, the smaller the diameter and the greater the height H, the more the ball will be restrained from leaving the aforesaid cavity. Thus, as shown in FIGS. 8*b*, 8*c*, 8*e* and 8*f*, the wall 5 effectively provides a stop restraining movement of ball and board relative to each other. Although the board is shown level in each of FIGS. 8*a* to 8*f*, it will also readily be appreciated that the user can tip the board slightly, both longitudinally, transversely or in all senses in between, so that there is a degree of spherical freedom in all directions. The user may also move the board in translational directions relative to the ball, the only substantially restrained direction effectively being the vertical. The restraint will not be complete, as the ball will compress to some extent. Particularly skilled users may also be able to perform tricks in which board and/or ball may be bounced.

Figure 9:
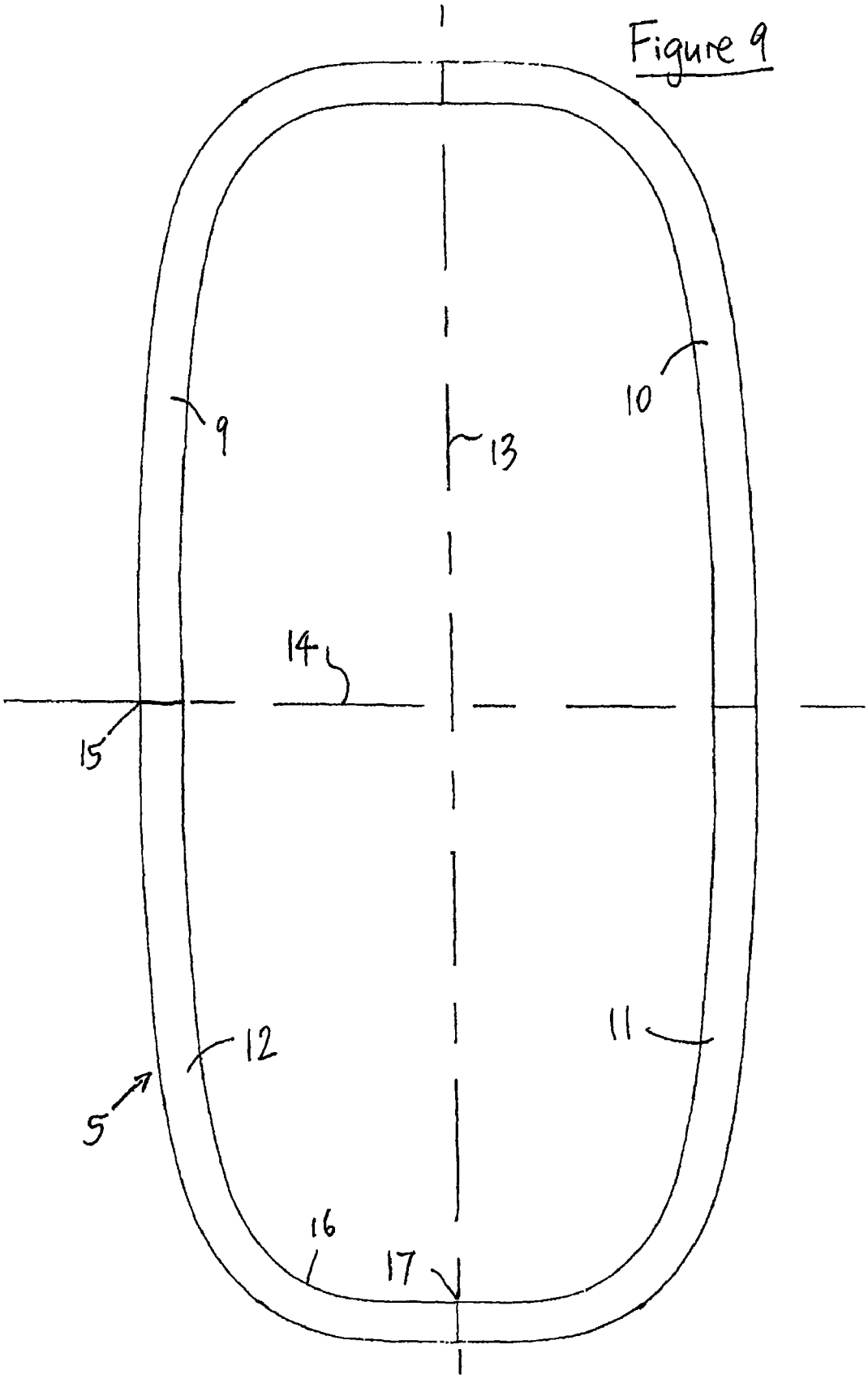
FIG. 9 shows the endless wall in plan view and on a larger scale.

Referring now to FIGS. 9 to 11 which illustrate the preferred form for the depending wall member 5, the wall may be formed of four segments 9, 10, 11 and 12 which are suitably fastened to under side 3 of board 1 to form the continuous wall 5, with each segment butting its neighbours. It will be appreciated that it is by no means essential that the segments should butt without gaps. Thus the wall may have discontinuities where there are minor gaps between segments of the wall without affecting the ability of the wall to restrain a ball within the region bounded by the wall. As can be seen from FIG. 9, segments 9 and 11 are identical while segments 10 and 12 are their mirror image. It can also readily be seen from FIG. 9 that wall 5 takes substantially the shape of a flattened oval hoop defining a longitudinal axis 13 for the board 1 and a transverse axis 14. As can be seen from FIGS. 9 and 10, the radius of curvature of wall 5 decreases from the intersection of the wall 5 with the transverse axis at a position 15 to a position 16 and then increases again from position 16 until the wall 5 intersects the longitudinal axis at a position 17, thereby providing the flattened oval shape. This shape is important because it allows a user to make transverse movements, as shown in FIGS. 8*d*, 8*e* and 8*f*, even at the extreme longitudinal end of travel of the board relative to the ball (FIGS. 8*b* and 8*c*). In this way, even on dry land, use of the balance board 1 and ball 8 enables a user to mimic the movements used in practice to control a surf board in surf.

In addition to its use in training surfers on dry land and snow boarders without snow, the wide range of movement allowed by the described embodiment of board, together with the practical provisions making it less likely in practice that a user will fall makes the board useful for Physiotherapy and for rehabilitation of accident victims. Board balancing may even become a sport in its own right.

The mere provision of a depending wall, as explained above, provides a restraint on movement of the ball from under the board, which would cause a user to fall. Because the ball will make contact with the edge of the wall at the extremes of its motion, edges of the wall 5 are preferably rounded as shown at 18 in the cross sectional view of FIG. 11 to reduce the likelihood of damage to the ball.

The likelihood of falling from the board by over-balancing can be reduced by selection of the maximum longitudinal and transverse distances across the bounded portion 6. If the distance between the centre of a ball in one extreme longitudinal position and in the other extreme longitudinal position does not exceed the distance between the user's feet (their stance), the balance position at the extreme longitudinal position, where all the user's weight is taken on one foot with the board horizontal, will be vertically over the centre of the ball, and hence over the points of contact of the ball with board and with the ground. Similarly, if the distance between the centre of a ball in one extreme transverse position and in the other extreme transverse position does not exceed the distance from the user's heel to the user's toes, the extreme balance points transversely, when all the weight is taken on the user's toes or on the user's heels, with the board horizontal, may also be over the centre of the ball. Allowing for an additional margin of safety, and because users may differ in their stance and in the size of their feet, in preferred boards, the longitudinal distance is slightly less than an average stance, while the transverse distance is slightly less than the average distance from heel to toes (See FIGS. 8*b*, 8*c*, 8*e* and 8*f*).

Although the embodiment of balance board illustrated in FIGS. 1 to 11 of the accompanying drawings will satisfy the majority of users, special limited edition boards may be provided with an extra length and with grip panels 7 across the whole length of the board to enable an advanced user to practice board walking and "hang-ten" procedures. A particularly light board may be provided for tricks. While a board typically with a dimension in the longitudinal direction of between 50 cm and 80 cm may satisfy most requirements, dimensions of the board may be matched to the height and stance of a user.

Although the illustrated board is essentially flat, it will be seen that in plan view the board is slightly waisted at 19. Edge regions 20 of the board in this waisted region 19 may have their thickness tapered towards the edge. Again, while the board is essentially flat, the longitudinal ends may be curved upwardly in regions longitudinally beyond the wall 5, adopting a shape similar to skate boards.

Although the preferred configuration for the endless wall is that of a flattened oval hoop, other shapes are feasible. For example, in a less preferred arrangement, the shape of the wall may form a simple rectangular frame. However, the arrangement illustrated is much to be preferred. Not only do the flat end regions 21 allow transverse training at longitudinal extremes where the weight may be largely taken through one foot, but the gently curved sides allow large graceful curves from end to end at either transverse extreme with a smooth transition between one movement and another. Moreover, the rounded shape not only maximises the area in which the ball can be safely used but, together with the rounded profile for the wall itself, as shown in FIG. 11, minimises wear on the ball and on the floor.

Accordingly, it will be appreciated, that the choice of a depending wall in the form of a flattened oval hoop, as in the embodiment described above, is significant both for allowing a wide range of movements and for safety considerations, while still allowing ease of manufacture.

It will also be appreciated that, although described above in terms of joining one or more wall portions to the underside of a main board portion, the entire structure could be moulded as an integral structure from plastics.

The embodiment of balance board 101 illustrated in FIGS. 12 to 17 of the drawings has a top side 102 and an under side 103. The under side 103 includes a substantially flat region 104 bounded by a continuous wall 105. The board is formed of two portions preferably laminated together, although other methods of joining may be employed. A top portion 106 defines the top side 102 of the board and also the substantially flat region 104. Second portion 107 has an opening 108 which defines the wall 105.

The dimensions of the wall 105 may be identical to the inner dimensions of the depending wall portion 19 of the first embodiment. In effect, the second embodiment of board simply has a depending wall portion that extends to the boundary of the board.

The second embodiment of board may be used in exactly the same way as the first embodiment.

Where the second embodiment differs from the first is in ease of manufacture. Similarly dimensioned portions 106 and 107 may be formed on the same tool, with some of the portions having a cut-out to provide opening 108. Two portions, one with an opening, and one without, are then simply laminated together. However, it will also be readily appreciated that a structure that operates in the same fashion could be made with the lower portion in several distinct pieces that need not abut perfectly to form a continuous wall 105. Discontinuities in the wall formed by small gaps will not affect the board in use. It will also be appreciated that otherwise identical, but integral, structures may be formed by moulding the board from plastics in a single piece.

What is claimed is:

1. Exercise apparatus comprising a balance board in combination with a ball;

the balance board being shaped to define a generally longitudinal direction and a direction generally transverse to the longitudinal direction;

the board having a top side that extends continuously over the longitudinal and transverse extent of the board, the whole surface of which top side is available for a user to balance upon, and an under side;

the board being formed from a first top portion defining said top side and having a substantially flat region on its under side and a second lower portion defining a wall projecting from the substantially flat region and having an inner surface defining a region at least substantially bounded by said inner surface and consisting of at least a portion of said substantially flat region, the distance across the bounded region in the longitudinal direction of the board being greater than in the transverse direction, and the ball having a diameter less than the distance across the bounded region in the transverse direction;

the ball being entirely separate from the board, and the bounded region being arranged to be freely mounted on top of the ball;

the board being enabled to move relative to the ball, when the bounded region is balanced on the ball and a user balances on the top side, with at least a degree of spherical rotational freedom and also a degree of translational freedom in directions other than the vertical, and with the inner surface of the wall defining both a maximum extent for movement of the board relative to the ball and a restraint against the ball rolling out from under the bounded portion.

2. Exercise apparatus according to claim 1, wherein the second lower portion is substantially co-extensive with the top portion in the longitudinal and transverse directions, the second portion having a through opening therein, the bounded portion consisting of that portion of the top portion that is exposed within the through opening.

3. Exercise apparatus according to claim 1, wherein the second lower portion comprises a wall member that depends from the substantially flat region on the underside of the first top portion, the bounded region consisting of that portion of the substantially flat region within and bounded by the wall member.

4. Exercise apparatus according to claim 1, wherein the board is integrally moulded from plastics material in a single piece.

5. Exercise apparatus according to claim 1, wherein the board is symmetrical about the longitudinal direction and also symmetrical about the transverse direction.

6. Exercise apparatus according to claim 1, wherein the wall defines a boundary with the shape of a flattened oval comprising a generally oval shape having ends that are flattened from true oval shape.

7. Exercise apparatus according to claim 6, wherein at least a portion of the top side of the board defines positions for a user's feet and the portions are provided with a surface constructed to resist slipping of the user's feet.

8. A balance board having a top side and an under side, the under side being arranged to be mounted on top of a ball with a user balancing on the top side, the board being shaped to define a generally longitudinal direction and a direction generally transverse to the longitudinal direction, the board being formed from a first top portion defining said topside and a second lower portion substantially co-extensive with the top portion in the longitudinal and transverse directions and being joined to the first top portion, the second portion having a through opening therein, whereby a substantially flat portion of the underside of the first portion is exposed, said substantially flat portion being bounded by a wall defined by said through opening, the distance across said substantially flat portion in the longitudinal direction of the board being greater than in the transverse direction, so that, with the said substantially flat portion balanced on a ball with a diameter less than the distance across the said substantially flat portion in the transverse direction, the board is enabled to move relative to the ball with at least a degree of spherical rotational freedom and also a degree of translational freedom in directions other than the vertical.

9. A balance board according to claim 8, wherein the board is symmetrical about the longitudinal direction and also symmetrical about the transverse direction.

10. A balance board according to claim 8, wherein the wall defines a boundary with the shape of a flattened oval comprising a generally oval shape having ends that are flattened from true oval shape.

11. A balance board according to claim 8, that includes a high friction layer secured to the working portion to resist slipping of a user's feet.

12. A balance board having a top side and an under side, the under side being arranged to be mounted on top of a ball with a user balancing on the top side, the board being shaped to define a generally longitudinal direction and a direction generally transverse to the longitudinal direction and having a substantially flat region on its under side to which is mounted a wall member that depends from said under side and defines a working portion of said substantially flat region within and bounded by said wall, the distance across said working portion in the longitudinal direction of the board being greater than in the transverse direction, so that, with the said working portion balanced on a ball with a diameter less than the distance across the said working portion in the transverse direction, the board is enabled to move relative to the ball with at least a degree of spherical rotational freedom and also a degree of translational freedom in directions other than the vertical.

13. A balance board according to claim 12, wherein the board is symmetrical about the longitudinal direction and also symmetrical about the transverse direction.

14. A balance board according to claim 12, wherein the wall defines a boundary with the shape of a flattened oval comprising a generally oval shape having ends that are flattened from true oval shape.

15. A balance board according to claim 12, that includes a high friction layer secured to the working portion to resist slipping of a user's feet.

16. A balance board according to claim 12, in combination with a ball whose diameter is less than the distance across the said portion in the transverse direction.

17. A balance board according to claim 16 wherein:

the wall defines a boundary with the shape of a flattened oval comprising a generally oval shape having ends that are flattened from true oval shape.

* * * * *